US011446538B2

(12) United States Patent
Silveira

(10) Patent No.: US 11,446,538 B2
(45) Date of Patent: Sep. 20, 2022

(54) COMPETITIVE WEIGHTLIFTING MACHINE AND METHODS FOR USING THE SAME

(71) Applicant: Matthew Silveira, Turlock, CA (US)

(72) Inventor: Matthew Silveira, Turlock, CA (US)

( * ) Notice: Subject to any disclaimer, the term of this patent is extended or adjusted under 35 U.S.C. 154(b) by 33 days.

(21) Appl. No.: 17/207,760

(22) Filed: Mar. 22, 2021

(65) Prior Publication Data

US 2021/0213321 A1 Jul. 15, 2021

Related U.S. Application Data

(63) Continuation of application No. 16/459,628, filed on Jul. 2, 2019, now Pat. No. 11,207,556.
(Continued)

(51) Int. Cl.
*A63B 21/078* (2006.01)
*A63B 21/062* (2006.01)
(Continued)

(52) U.S. Cl.
CPC ..... *A63B 21/078* (2013.01); *A63B 21/063* (2015.10); *A63B 24/0062* (2013.01);
(Continued)

(58) Field of Classification Search
CPC ..... A63B 21/00058; A63B 21/00061; A63B 21/00065; A63B 21/00069; A63B 21/062; A63B 21/0622; A63B 21/0624; A63B 21/0626; A63B 21/072; A63B 21/0724; A63B 21/075; A63B 21/078; A63B 21/0783; A63B 21/4023; A63B 21/4027; A63B 21/4033; A63B 21/4035;
(Continued)

(56) References Cited

U.S. PATENT DOCUMENTS 3,573,865 A 4/1971 Annas et al.
4,422,636 A 12/1983 de Angeli
(Continued)

OTHER PUBLICATIONS

Bruce Pechman, Fitness Equipment Review: Rep-Maxx "RM 250" Computer Controlled Intelligent Bench Press Machine, Jul. 2011, available online at www.mrbicep.com.
(Continued)

*Primary Examiner* — Gary D Urbiel Goldner
(74) *Attorney, Agent, or Firm* — Sierra IP Law, PC; William K. Nelson

(57) ABSTRACT

The present invention provides a competitive weightlifting system capable of interacting with and comparing weightlifting performances of multiple users, and creating competition between such users by displaying a ranked list of performances by those users. The system may include a frame for supporting and guiding a lift bar, sensors mounted to the frame for measuring and refereeing the performance of a user, a controller housed in the frame for tracking and ranking user performances with an interface for creating and logging into user profiles, and a communication device for sharing user performance data with other remote competitive weightlifting systems (e.g., competitive weightlifting systems in other gyms or homes) in order to create a wide-ranging competition between, and ranked leaderboard of, the many users.

22 Claims, 7 Drawing Sheets

Related U.S. Application Data

(60) Provisional application No. 62/764,207, filed on Jul. 23, 2018.

(51) Int. Cl.
*A63B 24/00* (2006.01)
*A63B 23/04* (2006.01)
*A63B 21/00* (2006.01)

(52) U.S. Cl.
CPC ... *A63B 21/4035* (2015.10); *A63B 2023/0411* (2013.01); *A63B 2024/0068* (2013.01); *A63B 2225/20* (2013.01)

(58) Field of Classification Search
CPC . A63B 21/4043; A63B 21/4045; A63B 23/04; A63B 23/0405; A63B 23/12; A63B 23/1209; A63B 23/1236; A63B 2023/0411; A63B 24/0003; A63B 24/0006; A63B 24/0021; A63B 24/0059; A63B 24/0062; A63B 24/0084; A63B 2024/0012; A63B 2024/0028; A63B 2024/0031; A63B 2024/0034; A63B 2024/0068; A63B 2024/0071; A63B 71/0054; A63B 71/0619; A63B 71/0622; A63B 2071/0063; A63B 2071/0072; A63B 2071/0081; A63B 2071/0625; A63B 2071/0627; A63B 2071/0675; A63B 2208/0223; A63B 2208/0242; A63B 2208/0252; A63B 2220/10; A63B 2220/12; A63B 2220/13; A63B 2220/17; A63B 2220/18; A63B 2220/50; A63B 2220/51; A63B 2220/52; A63B 2220/58; A63B 2220/80; A63B 2220/801; A63B 2220/802; A63B 2220/803; A63B 2220/805; A63B 2220/83; A63B 2220/833; A63B 2220/89; A63B 2225/02; A63B 2225/09; A63B 2225/093; A63B 2225/15; A63B 2225/20; A63B 2225/50; A63B 2225/52; A63B 2225/54; A63B 2225/72; A63B 2244/09
See application file for complete search history.

(56) References Cited

U.S. PATENT DOCUMENTS 4,471,956 A 9/1984 Marlo
4,620,703 A 11/1986 Greenhut
4,650,185 A 3/1987 Cartwright
4,763,897 A 8/1988 Yakata
4,807,875 A 2/1989 Tanski
4,822,036 A 4/1989 Dang
4,834,365 A 5/1989 Jones
4,836,536 A 6/1989 Jones
4,863,161 A 9/1989 Telle
4,875,676 A 10/1989 Zimmer
4,902,009 A 2/1990 Jones
4,989,859 A 2/1991 Jones
5,048,826 A 9/1991 Ryan
5,102,121 A 4/1992 Solow et al.
5,310,394 A 5/1994 Kallios
5,314,394 A 5/1994 Ronan
5,331,851 A 7/1994 Parviainen
5,344,374 A 9/1994 Telle
5,407,403 A 4/1995 Coleman
5,722,921 A 3/1998 Simonson
5,785,632 A 7/1998 Greenberg et al.
5,823,921 A 10/1998 Dawson
5,993,356 A 11/1999 Houston et al.
6,293,892 B1 9/2001 Slawinski et al.
6,379,287 B1 4/2002 Slawinski et al.
6,537,182 B2 3/2003 Slawinski et al.
6,558,299 B1 5/2003 Slattery
6,632,159 B1 10/2003 Slattery
6,669,607 B2 12/2003 Slawinski et al.
6,749,538 B2 6/2004 Slawinski et al.
6,893,381 B2 5/2005 Slawinski
6,926,649 B2 8/2005 Slawinski
7,029,426 B1 4/2006 Fuller, Sr.
7,163,488 B2 2/2007 Anders et al.
7,278,958 B2 10/2007 Morgan
7,374,515 B2 5/2008 Slawinski et al.
7,455,621 B1 11/2008 Anthony
7,527,568 B2 5/2009 Joseph
7,575,537 B2 8/2009 Ellis
7,591,771 B2 9/2009 Rullestad
7,666,118 B1 2/2010 Anthony
7,713,179 B2 5/2010 Webber
7,963,886 B1 6/2011 Schwinn et al.
8,900,097 B1 * 12/2014 Griggs ..... A63B 21/4043 482/4
8,992,385 B2 3/2015 Lemos et al.
9,272,179 B2 3/2016 Lemos et al.
9,409,053 B1 * 8/2016 Todd ..... G16H 20/30
11,207,556 B2 * 12/2021 Silveira ..... A63B 21/0626
2003/0069108 A1 4/2003 Kaiserman et al.
2004/0254050 A1 12/2004 Morgan
2005/0233871 A1 10/2005 Anders et al.
2006/0135324 A1 6/2006 Rullestad et al.
2006/0252615 A1 11/2006 Melcer
2007/0179030 A1 8/2007 Slawinksi
2009/0312162 A1 12/2009 Maiaro et al.
2010/0216600 A1 8/2010 Noffsinger
2012/0040799 A1 2/2012 Jaquish et al.
2012/0058859 A1 3/2012 Elson-Cook et al.
2013/0184128 A1 7/2013 Towley et al.
2013/0190143 A1 7/2013 Greenhill et al.
2014/0228175 A1 8/2014 Lemos et al.
2014/0330408 A1 * 11/2014 Rolley ..... G16H 10/60 700/91
2016/0263461 A1 * 9/2016 Kay ..... A63B 24/0087
2017/0246507 A1 * 8/2017 Kennington ..... A63B 21/0087
2017/0282002 A1 * 10/2017 Lee ..... A63B 23/03525
2017/0282013 A1 * 10/2017 Paulsen ..... A63B 21/023
2017/0282015 A1 * 10/2017 Wicks ..... A63B 24/0075
2018/0021629 A1 * 1/2018 DeLuca ..... A63B 21/00069 482/4
2018/0064992 A1 * 3/2018 Rothman ..... H04N 7/188
2018/0064994 A1 * 3/2018 Back ..... A63B 21/0783
2018/0243600 A1 * 8/2018 Kennington ..... A63B 21/0087
2018/0250553 A1 * 9/2018 Pendergast ..... A63B 24/0003
2020/0023226 A1 * 1/2020 Silveira ..... A63B 21/0626

OTHER PUBLICATIONS

Rep-Maxx, Advertisement for the RM 250 Bench Press machine, Jan. 2012.
Rep-Maxx, Advertisement for the RM 250 Bench Press and RM Squat machines, May 2012.
Rep-Maxx, Advertisement for the RM 250 Bench Press machine, National Fitness Trade Journal, Jan. 2012.
Rep-Maxx, Advertisement for the RM 250 Bench Press machine, National Fitness Trade Journal, Mar. 2012.
Rep-Maxx, Advertisement for the RM 250 and 450 Bench Press machines and RM Squat machine, National Fitness Trade Journal, May 2012.
Rep-Maxx, Advertisement for the RM 250 Bench Press machine, Oct. 2011.
Rep-Maxx, Advertisement for the RM 250 Bench Press machine, CBI Magazine, Feb. 2012.

* cited by examiner

100

COMPETITIVE WEIGHTLIFTING MACHINE AND METHODS FOR USING THE SAME

FIELD OF THE INVENTION

The present invention relates to weightlifting machines, and more particularly to a weightlifting rack which can track the performance of a user and rank that performance against the performances of competing users, and methods for using the same.

BACKGROUND OF THE INVENTION

More and more, our society is recognizing the health benefits of physical fitness, and an increasing number of the people maintain a gym membership, or keep exercise equipment at home, for that purpose. Correspondingly, weightlifting has increasingly become an activity of choice in the physical fitness regimen of the average gym-goer. However, motivation to continue giving one's best effort in maintaining physical fitness is a well-known and long-standing problem, and particularly so in the context of the busy lifestyles of modern parents and professionals. Indeed, countless products and marketing schemes are aimed at people who have a desire to lose weight and become more fit, but have trouble keeping up with their workout routine.

Gym-goers today have grown up using internet-connected gaming systems wherein continued use is encouraged through interaction and competition with other people, all of whom strive to improve their performance and move up the in-game leaderboard. Current weightlifting machines generally do not such interactive and competition-based functionality, and thus are lacking in potentially motivation and engagement mechanisms to aid gym-goers in maintaining their workout routines. Conventional weightlifting machines are thus deficient in providing social and competitive motivational tools to aid the modern gym-goer or workout enthusiasts.

Therefore, what is needed is an improved weightlifting system which is interactive and provides a competitive environment between users in order to motivate them to continuously put forth their best efforts in maintaining and improving their health.

SUMMARY OF THE INVENTION

The present invention provides a competitive weightlifting system capable of interacting with and comparing weightlifting performances of multiple users, and creating competition between such users by displaying a ranked list of performances by those users. The system may include a frame for supporting and guiding a lift bar, sensors mounted to the frame for measuring and refereeing the performance of a user, a controller housed in the frame for tracking and ranking user performances with an interface for creating and logging into user profiles, and a communication device for sharing user performance data with other remote competitive weightlifting systems (e.g., competitive weightlifting systems in other gyms or homes) in order to create a wide-ranging competition between, and ranked leaderboard of, the many users.

The system may include a frame having two primary and opposing vertical sides connected by multiple cross-members, creating an open frame into which the user may enter to use the weight-lifting equipment therein. The frame may comprise vertical support members having racks to support the weights while not in use for holding weights (e.g., weight plates of varying sizes, including but not limited to 5 lbs., 10 lbs., 25 lbs., 35 lbs., and 45 lbs.), lifting bars, etc.

The frame may have a pair of bar holders (e.g., pegs or seats) located on opposite sides of the frame for supporting the lift bar and any weights added to the lift bar. Each bar holder may have multiple, vertically arranged bar support devices for supporting the lift bar when the user is done with a weightlifting exercise, such as hooks, seats, pegs, or other devices for statically securing the lift bar at different heights, the system thus being operable to fit users of varying sizes, and to provide an emergency support for the lift bar if a user fails to complete a repetition (e.g., fails to lift the bar back to its initial height). The lift bar may also be connected to sleeves running on guide shafts on opposing sides of the frame. The guide shafts may be secured to the frame in a vertical position such that the path of the lift bar is safely limited to vertical or substantially vertical movement, preventing a user from falling forward or backward with the lift bar (e.g., similar to a Smith machine). The guide shafts may also each have a bump-stop adjustably secured to their lower ends, the bump-stops providing a lower limit to the movement of the lift bar, preventing a user from being trapped under the lift bar or injured from a falling lift bar if the user falls to the ground. The bump-stops may be adjustable in height, and along with the plurality of vertically arranged hooks of the bar holders, the system is able to accommodate users of different sizes and abilities. This versatility, along with a bench and/or other equipment for placement under the lift bar, allows the system to accommodate a plurality of different weightlifting exercises which necessitate different upper and lower limits for the lift bar (e.g., squats, bench press, deadlifts, overhead press, upright row, lying triceps extension, shoulder shrugs, leg press, and the like). The controller may be programmed with information related to each different type of exercise (e.g., rules regarding the proper high and low limits for the path of the lift bar during a repetition, whether the lift bar should be raised first or lowered first during a repetition, and whether a piece of equipment such as a bench must or must not be present under the lift bar during repetitions).

Each bar holder may further have beneath it a weight sensor (e.g., a digital scale) that is in wired or wireless communication with the controller. The weight of the lift bar may thus be accurately determined while obviating the need to manually enter information into the interface regarding the amount of weight to be lifted, preventing a user from mistaking or falsifying his or her performance data regarding the same. The system may allow the user to add or subtract weights (e.g., weight plates) from each end of the bar, or leave the same amount of weights on the bar that were used in the previous performance, and then indicate via the user interface that the weight of the lift bar (e.g., the sum of the weight of the lift bar and each of the added weight plates) is ready to be measured. The weight sensor may be comprised of at least one transducer (e.g., strain gauge, piezoelectric load cell), of which measures the weight of the lift bar by correlating a mechanical deformation (e.g., beam deflection) to electrical resistance, the resistance of the transducer typically increases with increased strain. More specifically, the transducer may utilize a circuitry (e.g., Wheatstone bridge, quarter bridge, etc.) to measure the output voltage, the voltage may be recorded in system memory and compared to predetermined weigh values stored in the systems storage (e.g., hard drive) as a table of values. Another method for determining the weight would allow a computer processor to compute the weight from a preset calculation. In a power lifting application or large digital scales a hydraulic transducer may be utilized, this method relates hydraulic pressure to weight; the reading may be recorded in system memory.

Each bar holder may further be mounted via a sleeve to at least one support post, the support post having at least one shock absorber near a lower end to absorb the shock when a user transfers the lift bar back onto the bar holder after an exercise, providing a cushioned contact and preventing excessive force from being transferred to the weight sensors under the bar holders. Together, the shock absorbers for each of the bar holders may be operable to fully resist the summed weight of the bar holders, while the weight of the bar and any weights added to the bar overcome the resistance of the shock absorbers. As such, the weight sensors under the bar holders may register zero weight when the lift bar is not engaged with the bar holders, and accurately measure only the weight of the lift bar and any weights that have been added to the lift bar when the lift bar is engaged with the bar holders. Alternatively, the shock absorbers may be operable to resist the weight of the bar holders and the lift bar, such that only the weights added to the lift bar are measured by the weight sensor, and the controller may be operable to automatically add a known weight of the lift bar to the weight measured by the weight sensors. In yet another alternative, the weight sensors may be operable to be calibrated (e.g., zeroed out) via the interface prior to adding weights to the lift bar, and the controller may be operable to automatically add a known weight of the lift bar to the weight measured by the weight sensors. Furthermore, lift bar calibration may account for the force added by the spring and the resistance of the shock absorbers, the spring constants and friction coefficients may be integrated as a calibration parameter in system calibration calculations. In some embodiments, an additional sensor (e.g., IR) may record the distance of compression of the spring and report the value to the controller.

The frame may further include a housing for each of the bar holders, each housing enclosing a bar holder, the support post(s) supporting the bar holder, and the weight sensor under the bar holder. Each housing may have a vertical slot through which only the bar support devices (e.g., hooks, seats, pegs, etc.) of the bar holder protrude, allowing the lift bar to be engaged with the bar holder. The weight sensors may be housed in the housings as well, below the bar holders. The housings may thus prevent tampering with the weight sensor (e.g., stepping on a scale) while the lift bar is being weighed. Each housing may have an access door, allowing maintenance and repair of the bar holder, support post(s), shock absorber(s), and weight sensor. The system may also be operable to sense tampering while the lift bar is weighed.

The system may include at least one tampering sensor mounted on the frame, the at least one tampering sensor being operable to detect when weight is artificially being added to the lift bar while it is weighed (e.g., by people at either end of the lift bar hanging on the lift bar) and when weights are removed from the lift bar after it is weighed (e.g., by a person removing weight plates from the ends of the lift bar), or people attempting to aid the lifter by applying force to the end of the bar during exercise. The at least one tampering sensor may include infrared sensors positioned on either side of the frame, the infrared sensors being operable to detect a person near an end of the lift bar by sensing heat emanating from the person's body. If a person is detected in the areas near the ends of the lift bar during or after the lift bar is weighed, the controller may sound and/or display an alert via the interface, and invalidate the weighing of the lift bar, preventing the user from starting a validated weightlifting exercise until the weighing of the weight bar is redone. Thus, competitive users (e.g., profiled users competing with the current user on the same weightlifting exercise), whether performing the weightlifting exercise at another time, or at another gym, may trust that the weight recorded in the current user's performance data is accurate. The one or more sensors may be infrared sensors (e.g., thermopile-thermocouple, bolometer, etc.). For example, the one or more sensors may be of the array type sensor comprising at least one large sensor or a plurality of micro sensors, the sensor may collect readings simultaneously for a field of view of the sensor and communicate with a processor (e.g., PLC), the processor may be operable to generate a thermal image (e.g., a temperature profile) of the space. The thermal image may output a voltage associated with the measured temperature and an array of voltage reading may be compared to values in system memory (e.g., table, log). If a voltage outputted from the measurement is within a range of tabulated human temperatures in the system memory, a processor may pause updates to the database and all sensors will stop recording measurements and may prompt the user that the exercise has been rejected or tampered with, and a processor may wait for an input from the user to continue the exercise. In the event the processor has indicated tampering the weightlifting machine may still be operable to continue the exercise, but specifically recording of sensor readings will cease. The processor may continue to record the exercise repetition within the same exercise set and/or may restart the exercise log. In other embodiments an array of temperature values is sent to a processor which may have a log in system memory which directly compares the temperature to a voltage. In other embodiments a thermal image may be rendered through image recognition to prevent misinterpretation of the object. The system may be operable to sense a spotter assisting the user in lifting the lift bar. The system may include at least one spotter sensor mounted to a vertical support member or horizontal cross-member of the frame, the at least one spotter sensor being operable to detect movement of an object in the space inside the frame behind and the user. The at least one spotter sensor may include a plurality of motion sensors mounted in a vertical series to a support member of the weight rack, the plurality of motion sensors being operable to detect when a spotter moves into the frame in order to assist the user in lifting the lift bar. If a person is detected in the frame behind the user during a repetition (e.g., that particular lowering and raising of the lift bar by the user), the controller may sound and/or display an alert and not count that repetition as part of the user's performance. Thus, if the user has performed nine repetitions, and cannot finish the tenth repetition without assistance, requiring a spotter to enter the frame and help the user get the lift bar back to its initial height (e.g., the height at which the user held the lift bar prior to starting the repetition), the system is operable to record only nine repetitions in the user's performance data. Thus, competitive users may trust that the number of repetitions recorded in the current user's performance data is accurate.

The system may be operable to sense when a repetition is done correctly. The system may include at least one proximity sensor mounted to the frame, the at least one proximity sensor being operable to detect when the lift bar comes within the range of the proximity sensor. The at least one proximity sensor may include a plurality of electronic sensors arranged vertically along the path of the lift bar, the plurality of electronic sensors being operable to detect the presence of the nearby lift bar as it passes by. Thus, the system may be able to detect whether the lift bar was lowered to an appropriate point for the type of exercise being performed, and/or raised to an appropriate height for the type of exercise being performed, such that the repetition was done correctly and validly. If the lift bar is not correctly lowered and raised, the controller may be operable to not count such movement as a valid repetition counted in the user's performance data. Thus, competitive users may again trust that the number of repetitions recorded in the current user's performance data is accurate.

The system may be operable to sense when equipment is properly located under the lift bar. The system may include at least one equipment sensor mounted to the frame, the at least one equipment sensor being operable to detect objects in the area under the lift bar during a weightlifting exercise. The at least one equipment sensor may include a photo eye sensor (e.g., a photoelectric sensor operable to determine the presence and distance of an object) operable to detect a bench under the lift bar and transmit information regarding the presence of the bench to the controller. If a bench is detected under the lift bar during a weightlifting exercise which does not call for a bench, the controller may be operable to display and/or sound an alert via the interface and not count any repetitions of the exercise performed by the user toward the user's performance data. The photo eye sensor may determine a change in a wavelength of light returning to the photo eye sensor and compare the value record with a table of values stored in system storage. A table of values may have a predetermined set of wavelengths related to the exercise a user has selected through a user interface. A programmable logic controller (PLC) may receive a voltage from an integrated electrical switch (e.g., relay, NPN transistor or PNP transistor) once the photo eye sensor has measured the wavelength associated with the user selected exercise.

The system may be operable to allow for a new user to set up a user profile via the interface. The interface may have a data entry device (e.g., a touchscreen), an imaging device (e.g., a camera), and an enunciator for making alert sounds (e.g., a speaker or emitter), and may be operable to prompt a user to log in to a user profile, or create a new user profile, prior to performing a weightlifting exercise. The interface may allow a new user to create a user profile by entering a user name and password, and taking a photograph via the imaging device. The interface may then allow the user to log in to the user profile, and performance data regarding all exercises performed while logged in to the user profile will automatically be recorded and associated with that user profile.

Once a user has a user profile and has logged in to the user profile, the system may be operable to prompt the user to select a weightlifting exercise type from a list of such exercise types (e.g., squat, bench press, overhead press, bent-over row, shoulder shrug, leg press, and the like). Once a user has selected a weightlifting exercise type, the system may then be operable to prompt the user to select a performance type from a list of such performance types (e.g., maximum weight, repetition competition, normal workout, and the like). Once a user has selected a performance type, the system may be operable to prompt the user to add or remove weights from the ends of the lift bar, if necessary (e.g., the user may add weight plate(s) to each of the two ends of the lift bar), and then indicate that the lift bar is ready to be weighed. Once the user indicates that the lift bar is ready to be weighed, the system may be operable to sense whether the weight of the lift bar is being tampered with via the at least one tampering sensor, as explained above. If the tampering sensor senses tampering with the weight of the lift bar, the system may be operable to sound an alert via the enunciator and show an alert via the interface of such tampering. The user may then be prompted to clear the tampering and restart the process of weighing the lift bar. The system may further be operable to record a tampering alert in the user's profile. If the lift bar is not being tampered with, the system may then weigh the lift bar via the weight sensors under the bar holders, and indicate via the interface that the user may now perform the weightlifting exercise.

Once the weightlifting exercise is ready to be performed, the system may be operable to begin sensing for: equipment under the lift bar via the equipment sensor; a spotter behind the user via the spotter sensor; and the correct performance of repetitions via the bar position sensor. If the chosen weightlifting exercise type calls for a piece of equipment to be placed under the lift bar (e.g., a bench for performing a bench press), and the equipment sensor does not sense such equipment under the lift bar, or if the chosen exercise type does not call for a piece of equipment to be placed under the lift bar (e.g., no equipment for a squat) but the equipment sensor senses a piece of equipment under the lift bar, the system may be operable to sound and/or show an equipment alert and not count any repetitions of the exercise performed by the user toward the user's performance data until the equipment alert is cleared. The user may be prompted to remove or add the equipment, as necessary, and clear the equipment alert via the interface prior to performing or continuing to perform any repetitions of the exercise. The system may further be operable to record an equipment alert in the user's profile.

If a spotter is detected in the area behind the user via the spotter sensor, as detailed above, the system may be operable to sound and/or show a spotter alert and not count any repetitions of the exercise performed by the user toward the user's performance data until the spotter alert is cleared. The user may be prompted to clear the spotter from the area and clear the spotter alert via the interface prior to performing or continuing to perform any repetitions of the exercise. The system may further be operable to record a spotter alert in the user's profile.

The system may be operable to determine the number of repetitions, and the high and low points of the lift bar during each repetition, via the bar position sensor. If the lift bar does not reach both an appropriate low point and an appropriate high point during a repetition of the chosen exercise, the system may be operable to sound and/or show a bar position alert and not count that repetition toward the user's performance data. The user may not be required to clear the bar position alert prior to resuming performance of the exercise.

Once the user ceases performing repetitions of the exercise, the system may be operable to prompt the user to acknowledge the termination of the performance via the interface. The system may also be operable to automatically terminate the performance of the exercise after a predetermined period in which the user fails to perform a repetition. The system may also be operable to automatically terminate the performance upon the lift bar being engaged with the bar holders, as determined by the weight sensor under the bar holders. Once the performance has been terminated, the system may be operable to record the performance data and associate the performance data with the user profile. The system may then be operable to automatically compare such performance data to the performance data of all other competitive users performing the same weightlifting exercise type and performance type, and update and display a ranked list of such performances via the interface, the ranked list including the user's identification associated with each user performance on the ranked list.

The system may be operable to connect to the internet via the communication device and regularly transmit data to a network of other competitive weightlifting systems (e.g., from about once per second to about once every 5 minutes, and preferably from about once every 5 seconds to about once every 30 seconds) in order to download, compare, rank, and display any new performance data recorded by such remote competitive weightlifting systems in the ranked list of user performances displayed via the interface. The network may be hosted by a network server that accumulates data of registered users. The communication device may allow the system to communicate directly with other individual competitive weightlifting systems, and/or to communicate with a network server which communicates with and gathers performance data from all other competitive weightlifting systems in the network.

The system memory may be operable to record data relating to: available exercise types and performance types, including any rules for each exercise type; many user profiles, including the user identification, password, and photograph for each; all performance data related to each user profile, including the exercise type, performance type, weight of the lift bar, and number of valid repetitions performed; all alerts associated with a user profile, including any tampering alerts, equipment alerts, and spotter alerts; and current and past ranked list data for each exercise and performance type.

The present invention may provide a competitive weightlifting system capable of interacting with and comparing weightlifting performances of multiple users, and creating competition between such users by displaying a ranked list of performances thereby. The system may comprise a lift bar, a frame, at least one each of a tampering sensor, an equipment sensor, a spotter sensor, and a bar position sensor, a controller, an interface, and a communication device.

The lift bar may comprise a shaft made from a strong and rigid material (e.g., metal, a metal alloy, carbon fiber, and the like), the shaft having a first end and a second end for supporting weights (e.g., weight plates). In some embodiments, the lift bar may comprise at least one grip area, wherein a surface of the lift bar is roughened (e.g., scored or dimpled) to provide better grip for the user's hand(s). In some embodiments, the bar may comprise a first latch at said first end for engaging with a bar support device (e.g., a hook, seat, peg, etc.) of a first bar holder, and a second latch at said second end for engaging with a bar support device of a second bar holder. In some embodiments, the lift bar may comprise a first guide sleeve for engaging with a first guide shaft of the frame, and a second guide sleeve for engaging with a second guide shaft of the frame. The first and second guide sleeves may each comprise a vertical cylindrical passage for engagement with (e.g., slidably encircling) the guide shaft, and a bar mount (e.g., a horizontally oriented sleeve or ring) rotatably mounted to the lift bar, such that the lift bar may be raised and lowered freely along the guide shafts, and rotated freely despite engagement with the guide shafts. The lift bar may thus be rotated by the user in order to move the first and second latch from an engagement position with the bar support devices of the bar holders (e.g., a substantially or nearly horizontal orientation), to a lifting position (e.g., a vertical orientation). In some embodiments, the first and second guide sleeve may each further comprise a pivot stop, the pivot stop being operable to prevent the latch from rotating past the engagement position.

In some embodiments, the lift bar may further comprise at least one detection plate, the detection plate being easily detected by the at least one proximity sensor (e.g., a inductive sensor, ultrasonic sensor, etc.) such that the proximity sensor may accurately sense the position of the lift bar. The detection plate may comprise a dense material (e.g., a metal) such that it may be easily detected by the proximity sensor. A proximity sensor for this application may typically be of the linear inductive proximity sensor type which generates a high frequency magnetic field from a coil, oscillator, and detector combination. A change in the proximity sensor amplitude of voltage output may relate to a reading of a detection plate which indicates a change in a positional threshold of the lift bar in a processor (e.g., PLC). A system memory may record the changes in a positional threshold and the processor may determine a series of lift bar thresholds passed and calculate the actual position of the lift bar. An array of proximity sensors may be connected to a centralized termination block (e.g., sensor/actuator block) may receive all connectors from the proximity sensor group and may regulate and refine a frequency sent to the processor. A list of values related to each proximity sensor may be stored in the systems memory and a processor may compare each proximity reading with values in the list to determine which sensor has indicated a pass.

The frame may comprise a plurality of support members mechanically connected such that frame comprises an open, substantially cubic shape. The support members and cross-members of the frame may be mechanically connected to each other via at least one of a welds, bolts and nuts, rivets, screws, bolts with cotter pins, heat fusion, and other similar devices and methods for connecting parts. The plurality of support members may comprise a plurality of vertical support members and a plurality of cross-members. In some embodiments, the frame may comprise a first side and a second side, the first and second sides being located opposite of each other and each having a plurality of vertically oriented members. The vertically oriented members may comprise a weight rack, a bar holder, a guide shaft, and a front panel, each connected to an upper horizontal support member and a lower horizontal support member. The first side may be connected to the second side via a plurality of cross-members. The frame may further comprise a plurality of access doors, each access door positioned to allow access to an inner compartment of the frame which houses the wiring and/or circuitry of one or more sensors of the plurality of sensors mounted to the frame. In some embodiments, an access door may be positioned adjacent to the mounting point of each sensor mounted to the frame, the access door providing access to the back side and wiring of the sensor. The plurality of access doors may each comprise a handle and lock to preventing tampering with the sensor's circuitry and/or wiring.

In some embodiments, the weight rack, bar holder, and a front panel may each be fixedly attached to the upper horizontal support member and the lower horizontal support member, while the guide shaft may be connected to the upper horizontal support member and the lower horizontal support member via removable connectors (e.g., bolts and nuts), and each of the first side and the second side may be connected to the linking cross-members between them via removable connectors (e.g., bolts and nuts), such that the frame may be at least partly disassembled for transport. In some embodiments, the upper horizontal support member of each of the first side and second side may further comprise a front extension and rear extension for supporting sensors.

The frame weight rack may comprise a plurality of weight support members (e.g., protrusions extending outwardly from the frame weight rack) for storing weights (e.g., weight plates of varying sizes, including but not limited to 5 lbs., 10 lbs., 25 lbs., 35 lbs., and 45 lbs.). The system may comprise a first frame weight rack on the first side of the frame and a second frame weight rack on the second side of the frame.

The bar holder may comprise a plurality of bar support devices for engaging with and securing the lift bar. In some embodiments, the bar holder may comprise a plurality of hooks arranged in a vertical row for securing the lift bar at different heights. The bar holder may further be mounted via at least one support sleeve to at least one support post. The support post may have at least one shock absorber at a lower end thereof to absorb the shock when a user transfers the lift bar back onto the bar holder after an exercise. In some embodiments, the bar holder may be mounted to a first support post on a first side of the bar holder via a first support sleeve, and to a second support post on a second side of the bar holder via a second support sleeve. In some embodiments, the first support sleeve may comprise an upper first support sleeve and a lower first support sleeve, and the second support sleeve may comprise an upper second support sleeve and a lower second support sleeve. In some embodiments, the lower first support sleeve may contact and be supported by a first shock absorber located at a lower end of the first support post and the lower second support sleeve may contact and be supported by a second shock absorber located at a lower end of the second support post.

In other embodiments, the bar holder itself may comprise a shock absorber (such as a spring shock, a hydraulic piston, etc.), while the support posts do not comprise a shock absorber. In such embodiments, the shock absorber may be positioned on the bar holder between an upper portion of the bar holder and a lower portion of the bar holder, the upper portion comprising the hooks and the support post sleeve(s) and the lower portion being operable to contact the weight sensor.

The system may further comprise at least one weight sensor for sensing the weight of the lift bar. In some embodiments, the at least one weight sensor may comprise a first weight sensor positioned under a lower end of the first bar holder and a second weight sensor positioned under a lower end of the second bar holder. Together the first and second shock absorbers of the first bar holder may be adapted to support only the weight of the first bar holder, and the first and second shock absorbers of the second bar holder may be adapted to support only weight of the second bar holder. As such, the first and second weight sensors may register zero weight when the lift bar is not engaged with the first and second bar holders. Subsequently, when the lift bar is engaged with the first and second bar holders, the weight of the lift bar and any weights added to the first and second ends of the lift bar, will cause the lower end of the first bar holder to press down onto the first weight sensor and the lower end of the second bar holder to press down onto the second weight sensor. Consequently, only the weight of the lift bar and the weights added to the lift bar are weighed by the first and second weight sensors, and the total weight lifted by the user is thus accurately measured. In some embodiments, the first and second weight sensors may each comprise a scale (e.g., a digital scale, etc.). In some embodiments, the first and second weight sensors may each be in wired or wireless communication with the controller.

In some embodiments, the first and second bar holders may each further comprise a housing for enclosing the respective bar holder the first and second support posts, and the respective weight sensor. Each of the first and second bar holder housings may have a vertical slot through which only the plurality of bar support devices protrude, allowing the lift bar to be engaged with the bar holders. The first and second bar holder housings may thus prevent tampering with the first and second weight sensors, respectively (e.g., stepping on the scale) while the lift bar is being weighed. Each of the first and second bar holder housings may further have an access door, allowing maintenance and repair of the respective bar holder, the first and second support posts, the first and second shock absorbers, and the respective weight sensor. In other embodiments, the first and second bar holders may not comprise a housing, but may comprise at least one sensor of a type and function described herein to prevent tampering with the weight sensor and/or the bar holder while the lift bar is being weighed.

The first and second guide shafts may limit the path of the lift bar (via the first and second guide sleeves) to a safe, vertical, up and down movement, preventing a user from falling forward or backward with the lift bar. The first and second guide shafts may each also have a bump-stop near its lower end, the bump-stop providing a lower limit to the movement of the lift bar, preventing a user from being trapped under the lift bar or injured from a dropped lift bar. Each of the bump-stops may comprise a sleeve for encircling the guide shaft, and each may comprise a tightening device (e.g., a threaded pin for tightening against the guide shaft, or a screw for tightening the bump-stop around the guide shaft) and may be adjustable in height along the length of its respective guide shaft.

The first side may comprise a first front panel and the second side may comprise a second front panel. The second front panel may comprise a housing with an access door, and may house the bar position sensor. In some embodiments, the second front panel may further support a second interface. The first front panel may comprise a housing with an access door, and may house the controller and support the interface. In some embodiments, the controller may comprise a central processing unit and a memory. The controller may be in electronic communication with and be operable to send information to and receive information from each of the memory, the user interface (including the imaging device and the enunciator), the communication device, and the plurality of sensors (e.g., the weight sensor(s), the tampering sensor(s), the equipment sensor(s), the spotter sensor(s), and the bar position sensor(s)).

In some embodiments, the controller may be operable to: prompt a user to log into a user profile or set up a user profile via the interface; receive information from a user via the interface regarding setting up a user profile (e.g., a chosen user identification and a chosen password); prompt the user via the interface to initiate capturing an image for the user profile; receive information from the user that the user is ready for the image to be captured; cause the imaging device to capture an image of the user; record in the memory and associate with a user profile the chosen user identification, the chosen password, and the captured image; receive information from a user via the interface regarding logging into a user profile (e.g., a user identification and password); retrieve data from the memory regarding said user profile; prompt the user via the interface to select a weightlifting exercise type and performance type; receive information from the user via the user the selected weightlifting exercise type and performance type; retrieve data from the memory regarding rules related to the exercise type and performance type; prompt the user via the interface to weigh the lift bar; receive information from the interface that the lift bar is ready to be weighed; cause the tampering sensor to sense for tampering with the weight of the lift bar; receive information from the tampering sensor regarding tampering with the lift bar; show and sound an alert regarding tampering with the weight of the lift bar; record the tampering alert via in the memory; prompt the user to clear the tampering alert; receive information from the user via the interface that the tampering alert has been cleared; receive information from the weight sensors regarding the weight of the lift bar, record the weight of the lift bar, prompt the user to begin performing the weightlifting exercise; cause the equipment sensor to sense for equipment under the lift bar; receive information from the equipment sensor regarding equipment under the weight bar; apply the rules of the weightlifting exercise to said information from the equipment sensor; show and sound an equipment alert; record the equipment alert via the memory; prompt the user to clear the equipment alert via the interface; receive information from the user via the interface that the equipment alert has been cleared; cause the spotter sensor to sense for motion in the area around the user; receive information from the spotter sensor regarding motion in the area around the user; show and sound a spotter alert; record the spotter alert via the memory; prompt the user via the interface to clear the spotter alert; receive information from the user via the interface that the spotter alert has been cleared; cause the bar position sensor to sense the position of the lift bar; apply the rules regarding the weightlifting exercise to the information received from the bar position sensor; determine from the information received by the bar position sensor the number of repetitions, and the high and low points of the lift bar during each repetition, performed by the user; show and sound a bar position alert; prompt the user to terminate the performance via the interface and automatically terminate the performance if the user fails to do so within a predetermined time period; receive information from the user via the interface that the performance has been terminated; record the number of repetitions and the weight of the lift bar in the user profile via the memory; upload data regarding the user performance to a remote computer via the communication device; download data regarding competitive user performances from a remote computer via the communication device and record such data in the memory; retrieve data from the memory regarding competitive user performances for the chosen weightlifting exercise type and performance type, compare the current user performance to the competitive user performances, and rank all recorded performances (current and competitive) for the chosen weightlifting exercise type and performance type; display a list of all ranked performances for a chosen weightlifting type and performance type; and display the current performance data separate from the list of all ranked performances if the current performance is not visible in the list of all ranked performances. In some embodiments, the controller may comprise a software application operable to perform each of the above listed functionalities of the controller. In some embodiments, multiple users may engage in the same weightlifting session by logging in to the user's respective profile via the user interface. The user interface would prompt the users to select which user is utilizing the weightlifting machine prior to each weightlifting exercise.

In some embodiments, the controller may be of a programmable logic controller and a microcontroller, or a combination of both in the same. The output performance of the each exercise may be logged in real-time a portion of controller memory may be dedicated to log the results of each workout session. Memory may be of the virtual type or dynamic type, and may be integrated in the controller and may have an expandable slot (e.g., SDRAM, UniDIMM). Once a workout session is complete the log of the workout results may be uploaded to the network.

In some embodiments, the controller may further comprise the communication device, the communication device being integral with the controller. In other embodiments, the communication device may be distinct from the controller, and may comprise a separate modem on the premises. In such embodiments, the communication device may be in wired or wireless communication with the controller. In some embodiments, the wireless communication between the controller and the communication device may comprise at least one of WiFi, Bluetooth, WLAN, cellular, radio, infrared, microwave, and other similar types of wireless communication.

The communication device may be operable to connect to a remote computing device (e.g., a network server, or a controller of another competitive) via the internet. In some embodiments, the communication device may communicate with the remote computing device via at least one of satellite, infrared, radio, microwave, cellular/mobile, WiFi, Bluetooth, wired, and other similar forms of electronic communication. The communication device may thus be operable to engage in electronic communications with the remote computing device and upload performance data related to users of the system, and download performance data related to users of other, remote competitive weightlifting systems (e.g., competitive weightlifting systems at other gyms or health clubs). In some embodiments, the system may not comprise a communication device, and the controller may compare and rank only the user performances of users of the present system.

The interface may comprise a display (e.g., a monitor) for displaying information to the user or users of the system, and an input device for allowing a user to input information (e.g., a keypad or touchscreen). In some embodiments, the display and the input device may be integral with each other (e.g., a touchscreen). In some embodiments, the interface may further comprise a security device for identifying the user (e.g., a fingerprint scanner, an eye scanner, a facial recognition scanner, and the like). In some embodiments, the interface may comprise an enunciator (e.g., a speaker or other sound emitting device) for sounding an alert. In some embodiments, the enunciator may be integral with the interface. In other embodiments, the enunciator may be distinct from the interface and separately mounted to the frame. In some embodiments, the interface may comprise an imaging device (e.g., a camera integral with the touchscreen), the imaging device being operable to capture an image of the user. In other embodiments, the imaging device may be distinct from the interface and may be separately mounted to the frame.

In some embodiments, the interface may comprise a first interface and a second interface, the first interface being mounted to the first front panel and comprising a first display, a first input device, a first enunciator, and an imaging device, and the second interface being mounted to the second front panel and comprising a second display and a second input device (e.g., a second touchscreen). In such embodiments, the first interface may be operable to allow a user to create a user profile, log into a user profile, select a weightlifting exercise type and performance type, initiate weighing of the lift bar, initiate the weightlifting performance, terminate the weightlifting performance, and clear any alerts. The first interface may further be operable to display a ranked list of user performances.

The second interface may be operable to display the currently selected weightlifting exercise type, the current weight being lifted, the current exercise type, the current user profile, and a ranked list of performance data. The second interface may further be operable to select a subsequent user (e.g., allow a user to get in line for using the system) and switch the current user profile to the subsequent user's user profile. In some embodiments, the second interface may be operable to allow the subsequent user to get in line to use the system by selecting the subsequent user's user profile from a list. In other embodiments, the subsequent user may be required to enter the subsequent user's user identification and password in order to get in line to use the system. In some embodiments, the second interface may further comprise a second security device and a second enunciator.

In some embodiments, the tampering sensor may comprise an infrared sensor. The infrared sensor may be a passive infrared sensor operable to measure infrared radiation being emitted from a relatively warm object (e.g., a human, as opposed to a lift bar or weight plate) in the sensor's field of view (e.g., the area around a weight bearing end of the lift bar). Infrared sensor technology is well known in the art of object heat signature detection. In some embodiments, the tampering sensor may comprise a commercially available infrared sensor (e.g., a SparkFun IR Array, a muRata pyroelectric infrared sensor, and the like). In some embodiments, the tampering sensor may comprise a plurality of tampering sensors, the plurality of tampering sensors being mounted to the frame at at least one of a crossbar or an extension thereof, a weight rack, a front panel, and an upper or lower support member of a side of the frame.

In some embodiments, the equipment sensor may comprise a photo eye sensor. The photo eye sensor may comprise a photoelectric sensor operable to determine the presence and distance of an object. The photo eye sensor may comprise an emitter to transmit electromagnetic radiation (e.g., a transmitter emitting infrared radiation) toward a specific area (e.g., the area under the lift bar where a bench may be placed), and a photoelectric receiver for measuring that electromagnetic radiation. The photo eye sensor may comprise at least one of a through beam type sensor, a retro-reflective type sensor, and a proximity-sensing type sensor. In some embodiments, the photo eye sensor may comprise a commercially available sensor (e.g., a QM/CX series sensor, a Through Beam SS/FA/FB series sensor, and the like). In some embodiments, the equipment sensor may be mounted to the frame at at least one of a crossbar or an extension thereof, a weight rack, a front panel, and an upper or lower support member of a side of the frame. In some embodiments, the equipment sensor may comprise a plurality of equipment sensors.

In some embodiments, the spotter sensor may comprise a motion sensor. The motion sensor may be an electronic motion detector comprising at least one of an optical sensor, a microwave sensor, and an acoustic sensor. The motion sensor may comprise an emitter for emitting at least one of electromagnetic radiation (e.g., light waves, microwaves, or radio waves) and ultrasonic waves, and the motion sensor may comprise a receiver for measuring at least one of electromagnetic radiation and ultrasonic waves in the motion sensor's field of view (e.g., the area next to the user where a spotter may be). The motion sensor may thus be able to detect the motion of a spotter entering the area near the user in order to help the user raise the lift bar. The motion sensor may comprise a commercially available sensor (e.g., a MakeBlock Me PIR Motion Sensor, a Gravity PRI Sensor, or the like). In some embodiments, the spotter sensor may be mounted to the frame at at least one of a crossbar or an extension thereof, a weight rack, a front panel, and an upper or lower support member of a side of the frame. In some embodiments, the spotter sensor may comprise a plurality of spotter sensors.

In some embodiments, the bar position sensor may comprise a proximity sensor. The proximity sensor may comprise an electronic sensor operable to detect the presence of nearby objects as they pass by the proximity sensor (e.g., the lift bar passing vertically along a support member of the frame). The proximity sensor may comprise an electromagnetic emitter for transmitting electromagnetic signal (e.g., infrared radiation) and an electromagnetic receiver for detecting changes in the return signal. In some embodiments, the bar position sensor may comprise a plurality of linearly and vertically arranged proximity sensors, each connected in parallel to a termination block, the termination block being in electronic communication with the controller. The termination block may be operable to receive information from each of the plurality of proximity sensors individually, translate the information from the plurality of proximity sensors into information regarding a position of the lift bar (e.g., the current height of the lift bar, the low point of the lift bar before rising again, the high point of the lift bar before lowering again, etc.), and send the information regarding a position of the lift bar to the controller. The proximity sensor(s) may comprise a commercially available sensor(s) (e.g., a Sharp IR range sensor, a SICK brand IMR sensor, or the like). The proximity sensor may be operable to easily determine the position of the lift bar by sensing a detection plate mounted to the lift bar (e.g., the detection plate being mounted to a guide sleeve, at a position facing the proximity sensor). In some embodiments, the bar position sensor may be mounted to the frame at least one of a weight rack, a front panel, and an upper or lower support member of a side of the frame. In some embodiments, the bar position sensor may comprise a plurality of bar position sensors.

In some embodiments if any sensor is triggered (e.g., detecting interference, tampering, etc.) a processor may prevent the logging of data to system memory and may prompt the user to address the issue via a graphical user interface, the machine will still function for exercising. Once user has addressed the issue indicated by the machine, a processor may continue to log the information to the system memory. If any sensor fails (e.g., breaks, damaged) a processor may prevent logging to the database, but will remain operational for completing a workout.

Further aspects and embodiments will be apparent to those having skill in the art from the description and disclosure provided herein.

It is an object of the present invention to provide a competitive weightlifting system which creates competition between users of the system.

It is a further object of the present invention to provide a competitive weightlifting system which allows a user to create and log into a user profile in order to track and rank the user's performance.

It is a further object of the present invention to provide a competitive weightlifting system which is operable to track more than one user during each exercise session.

It is a further object of the present invention to provide a competitive weightlifting system which motivates a user to continue giving one's best effort in maintaining physical fitness.

It is a further object of the present invention to provide a competitive weightlifting system which communicates with other weightlifting systems to create competition between users in multiple locations, potentially across the globe.

It is a further object of the present invention to provide a competitive weightlifting system operable to automatically and accurately count valid repetitions of a weightlifting exercise performed by a user via a plurality of sensors.

It is a further object of the present invention to provide a competitive weightlifting system operable to prevent tampering with the performance data regarding the weight lifted, equipment used, and assistance provided for a repetition.

It is a further object of the present invention to provide a competitive weightlifting system which is programmed with rules for multiple weightlifting exercise types and performance types.

The above-described objects, advantages and features of the invention, together with the organization and manner of operation thereof, will become apparent from the following detailed description when taken in conjunction with the accompanying drawings, wherein like elements have like numerals throughout the several drawings described herein. Further benefits and other advantages of the present invention will become readily apparent from the detailed description of the preferred embodiments.

DETAILED DESCRIPTION

Figure 1:
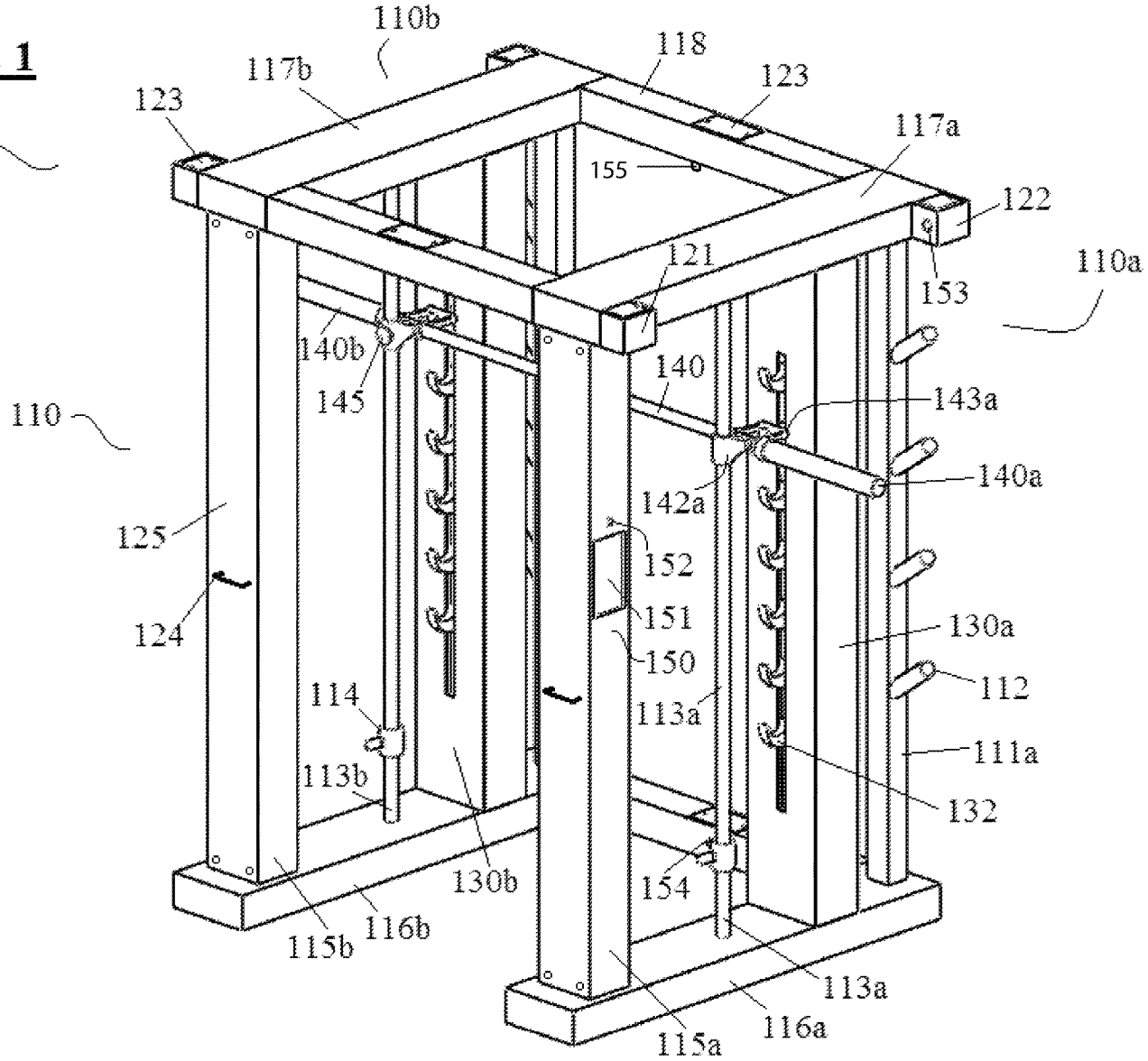
FIG. 1 shows a perspective view of a competitive weightlifting system, according to an embodiment of the present invention.
Figure 2:
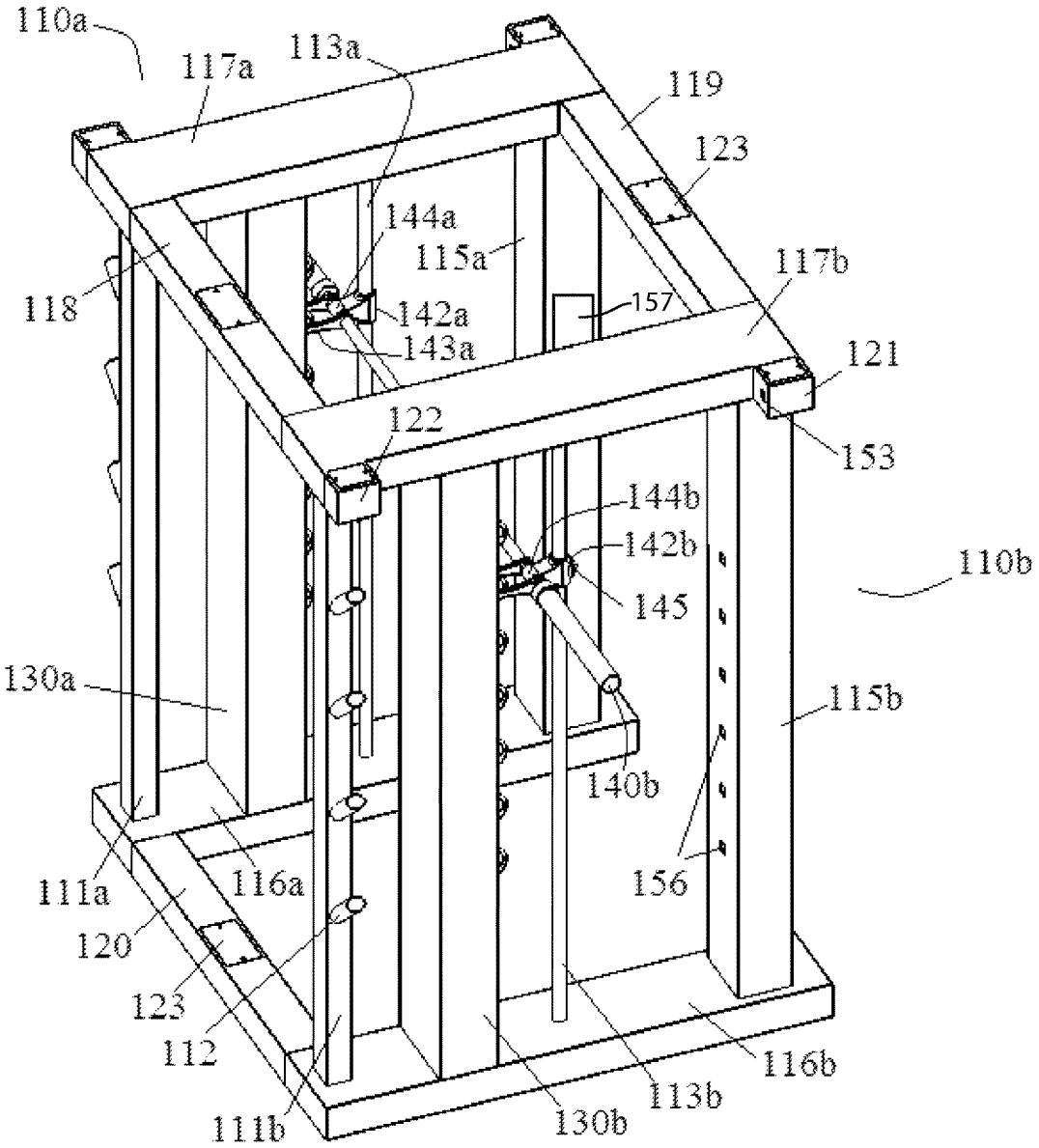
FIG. 2 shows a perspective view of a competitive weightlifting system, according to an embodiment of the present invention.

Reference will now be made in detail to certain embodiments of the invention, examples of which are illustrated in the accompanying drawings. While the invention will be described in reference to these embodiments, it will be understood that they are not intended to limit the invention. To the contrary, the invention is intended to cover alternatives, modifications, and equivalents that are included within the spirit and scope of the invention. In the following disclosure, specific details are given to provide a thorough understanding of the invention. However, it will be apparent to one skilled in the art that the present invention may be practiced without all of the specific details provided.

The present invention may provide a competitive weightlifting system 100 capable of interacting with and comparing weightlifting performances of multiple users, and creating competition between such users by displaying a ranked list of performances thereby. The system 100 may comprise a lift bar 140, a frame 110, a controller 150 with an interface and a communication device 158, and at least one each of a tampering sensor 153, an equipment sensor 154, a spotter sensor 155, and a bar position sensor 156.

The lift bar 140 may comprise a shaft made from a strong and rigid material (e.g., metal, a metal alloy, and the like), the shaft having a first sleeve 140*a* and a second sleeve 140*b* for receiving and supporting weights (e.g., weight plates). In some embodiments, the bar may comprise a first latch 143*a* at or near said first sleeve 140*a* for engaging with a hook, peg, or other bar support structure 132 of a first bar holder 130*a*, and a second latch 143*b* at said second sleeve 140*b* for engaging with a hook, peg, or other bar support structure 132 of a second bar holder 130*b*. In some embodiments, the lift bar 140 may comprise a first guide sleeve 142*a* for engaging with a first guide shaft 113*a* of the frame 110, and a second guide sleeve 142*b* for engaging with a second guide shaft 113*b* of the frame. The first and second guide sleeves 142*a*, 142*b* may each comprise a vertical cylindrical passage for engagement with (e.g., slidably encircling) their respective guide shaft 113*a*, 113*b*, and a bar mount 144 (e.g., a horizontally oriented sleeve or ring) engaged with the lift bar 140, such that the lift bar 140 may be raised and lowered freely along the guide shafts 113*a*, 113*b*, and rotated freely despite engagement with the guide shafts 113*a*, 113*b*. The lift bar 140 may thus be rotated by the user in order to move the first and second latches 143*a*, 143*b* from an engagement position with hooks 132 of the bar holders 130*a*, 130*b* (e.g., a substantially or nearly horizontal orientation), to a lifting position (e.g., a vertical orientation). The lift bar 140 may further comprise a detection plate 145 which acts like a location marker for the lift bar 140 as it moves along the guide shafts 113*a* and 113*b*. The detection plate 145 may be easily detected by the at least one proximity sensor 156 such that the proximity sensor 156 may accurately sense the position of the lift bar 140. The detection plate 145 may comprise a dense material (e.g., a metal) such that it may be easily detected by the proximity sensor 156 (e.g., the sensor may be an ultrasonic sensor, capacitive sensor, etc.).

The frame 110 may comprise a first side 110*a* and a second side 110*b*, the first and second sides 110*a*, 110*b* being located opposite of each other. Each of the first and second sides 110*a*, 110*b* may each comprise a weight rack 111*a*, 111*b*, a bar holder, 130*a*, 130*b*, a guide shaft 113*a*, 113*b*, and a front panel 115*a*, 115*b*, each connected to an upper horizontal support member 117*a*, 117*b* and a lower horizontal support member 116*a*, 116*b*. The first side 110*a* may be connected to the second side 110*b* via a plurality of horizontal cross-members 118, 119, 120 such that frame 110 comprises an open, substantially rectangular prism outer shape. The support members 111*a*, 111*b*, 115*a*, 115*b*, 116*a*, 116*b*, 117*a*, 117*b* and cross-members 118, 119, 120 of the frame 110 may be mechanically connected to each other via at least one of a welds, bolts and nuts, rivets, screws, bolts with cotter pins, heat fusion, and other similar devices and methods for connecting parts. The frame may further comprise a plurality of access doors 123, each positioned to allow access to an inner compartment of the frame 110 which houses the wiring and/or circuitry of a sensor 153, 154, 155. The plurality of access doors 123 may each comprise a handle and lock to preventing tampering with the sensor's circuitry and/or wiring. The first and second sides 110*a*, 110*b* may each further comprise a front extension 121 and rear extension 122, each supporting and housing a tampering sensor 153.

The weight racks 111*a*, 111*b* may each comprise a plurality of weight support members 112 for holding weights (e.g., weight plates of varying sizes, including but not limited to 5 lbs., 10 lbs., 25 lbs., 35 lbs., and 45 lbs.).

Figure 3A:
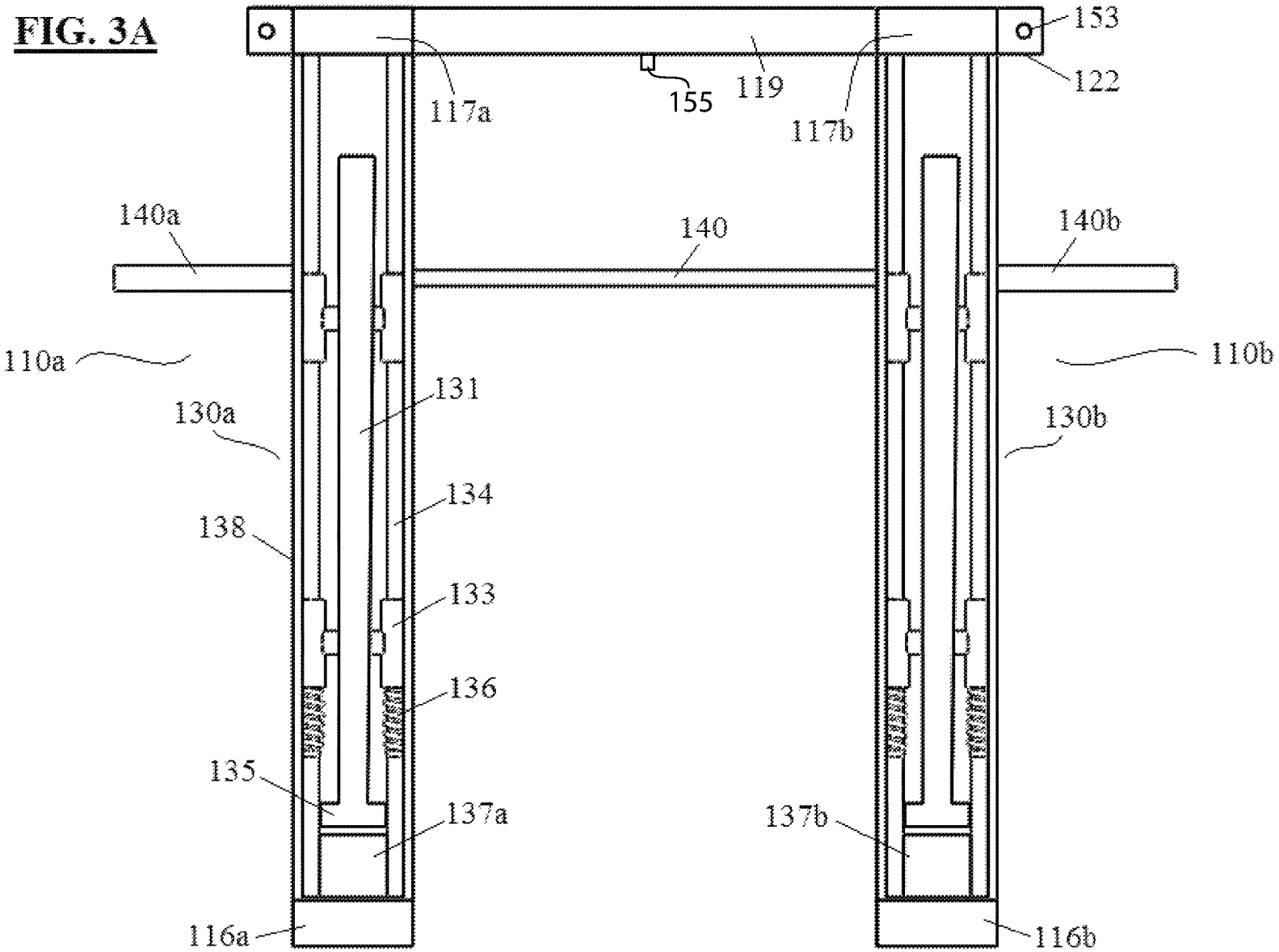
FIG. 3A shows a rear view of a competitive weightlifting system, according to an embodiment of the present invention.
Figure 3B:
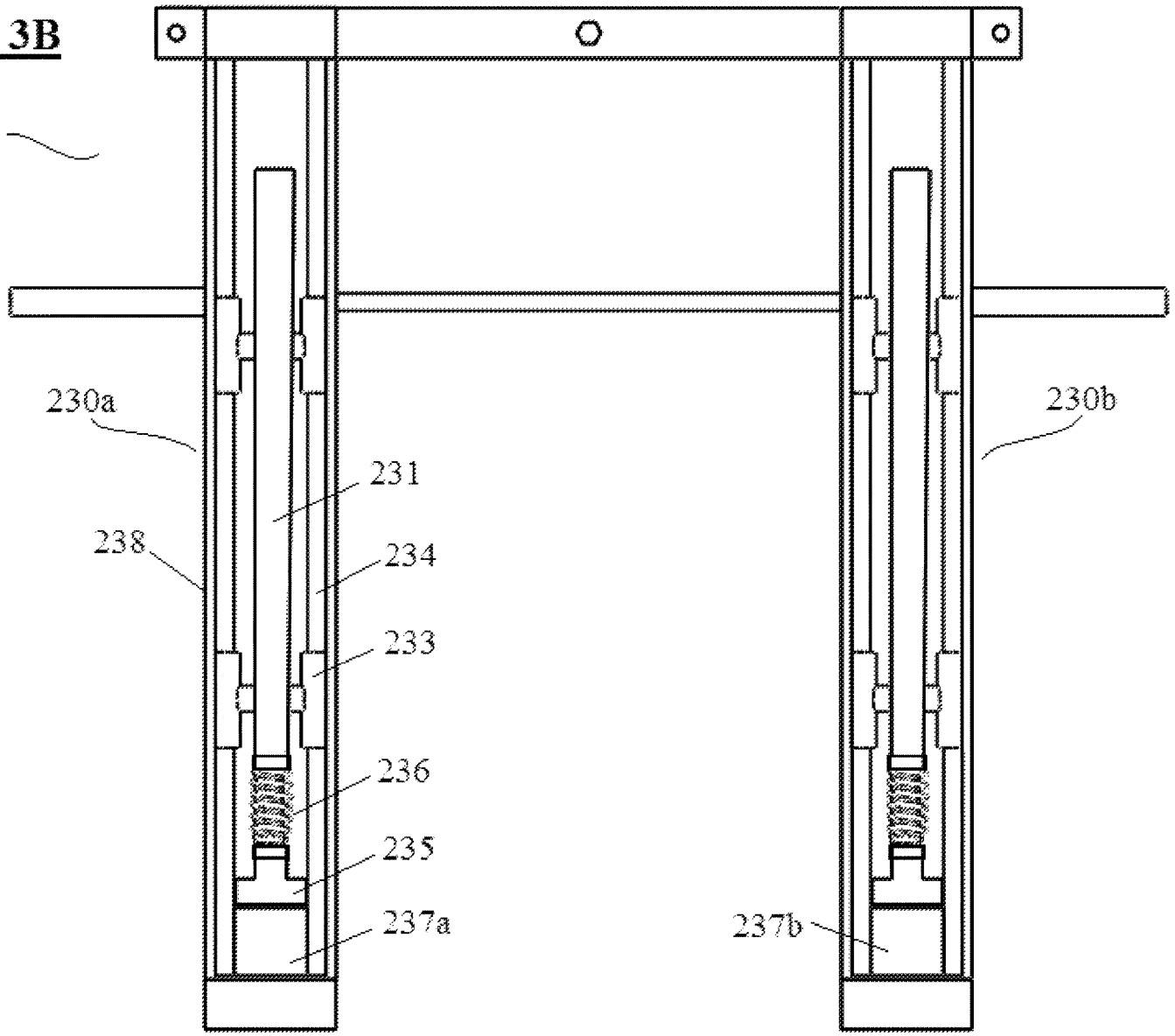
FIG. 3B shows a rear view of a competitive weightlifting system, according to an embodiment of the present invention.
Figure 4:
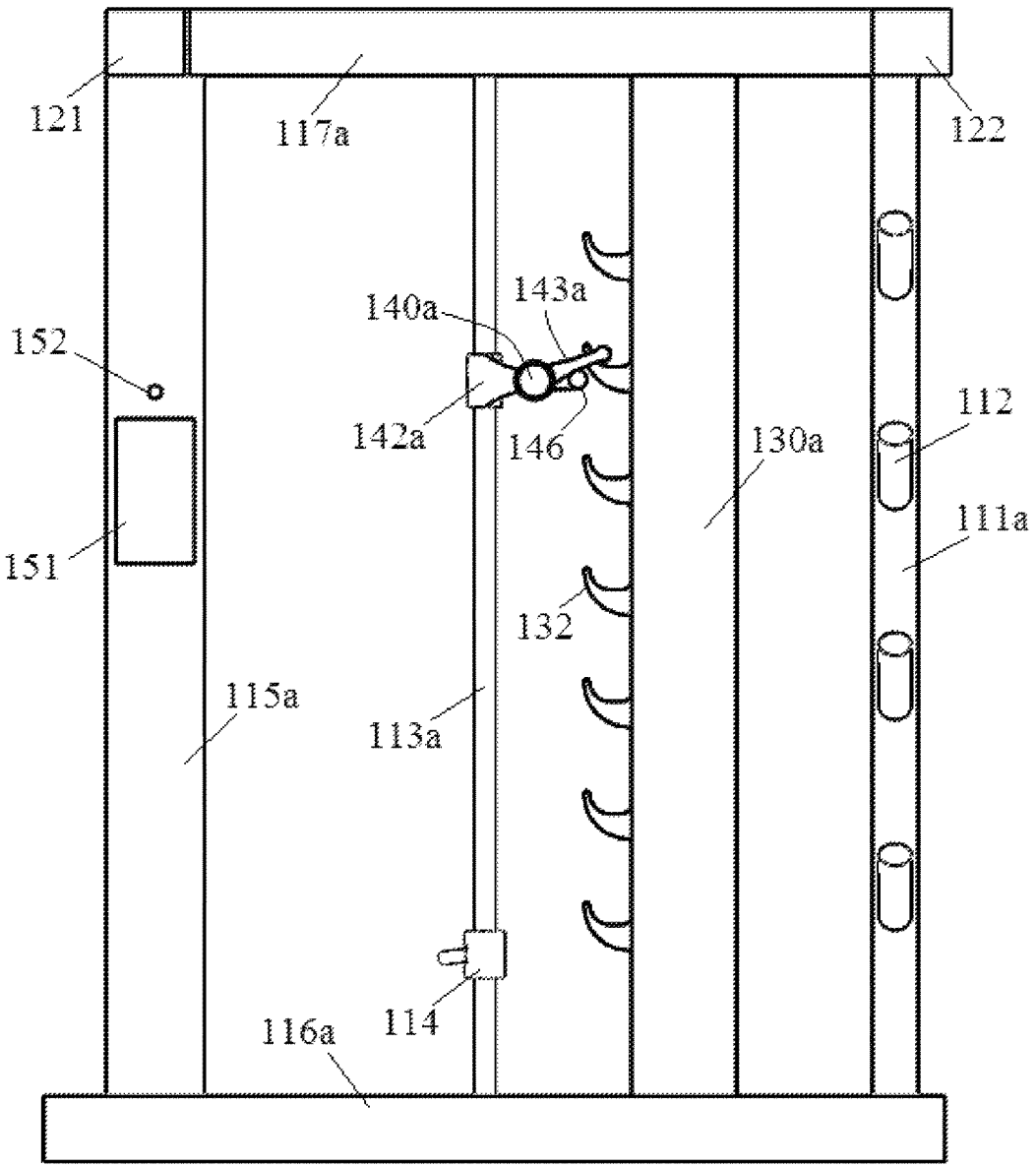
FIG. 4 shows a side view of a competitive weightlifting system, according to an embodiment of the present invention.
Figure 5:
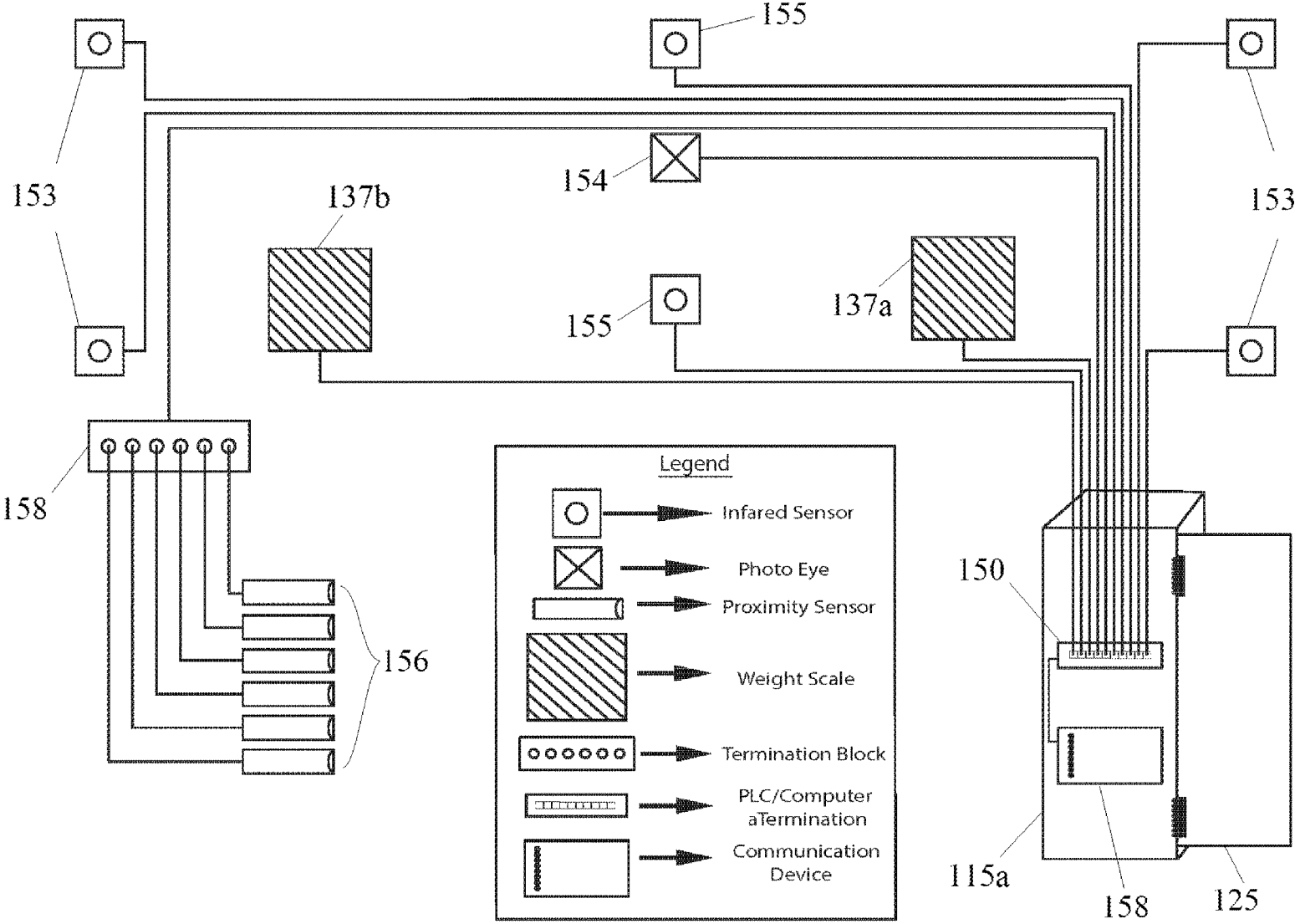
FIG. 5 shows a high-level diagram of the sensor wiring of a competitive weightlifting system, according to an embodiment of the present invention.
Figure 6:
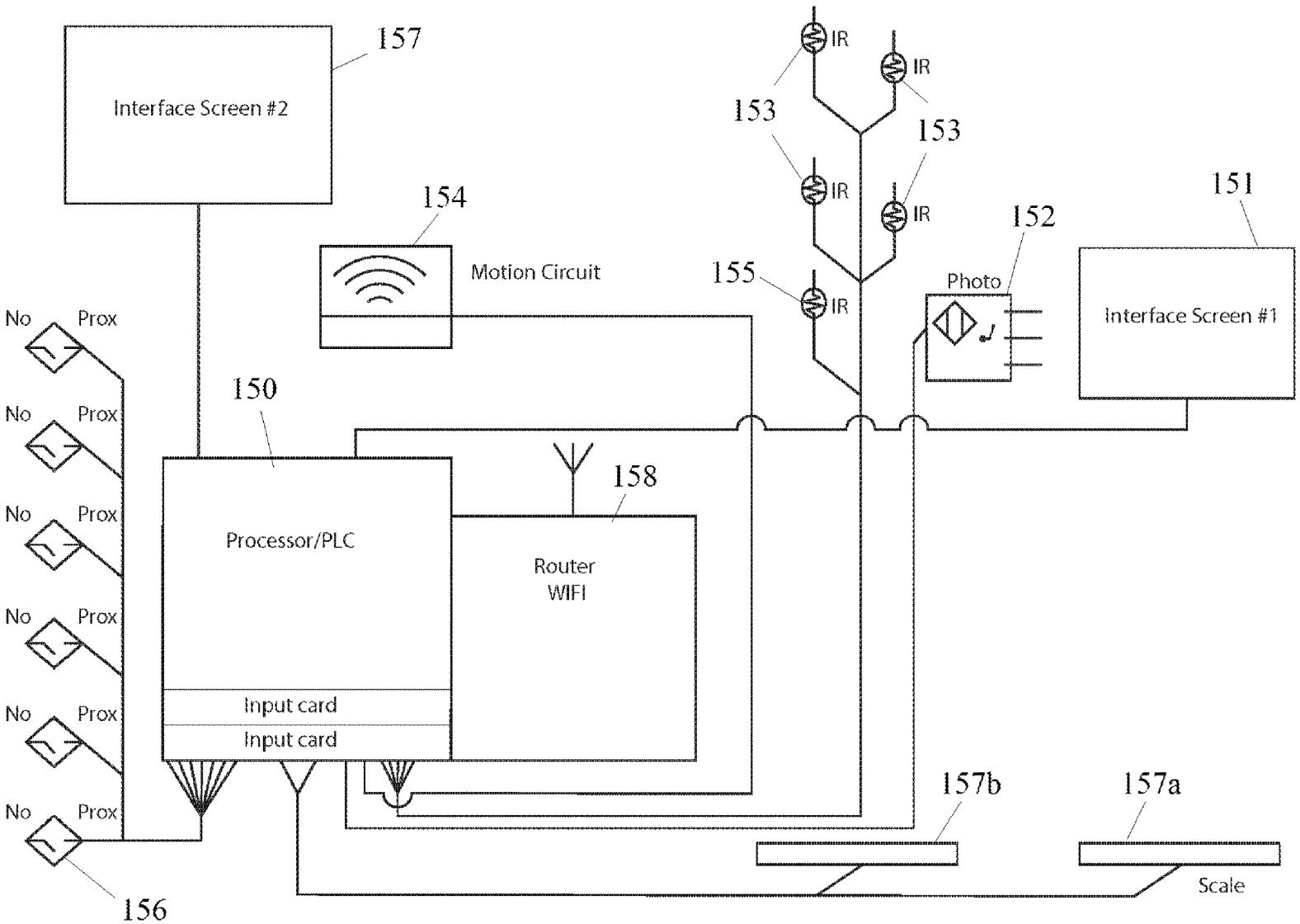
FIG. 6 shows a high-level diagram of the circuitry of a competitive weightlifting system, according to an embodiment of the present invention.

The bar holders 130*a*, 130*b* may each comprise a housing 138 enclosing a weight sensor 137*a*, 137*b* and central support 131 having a plurality of vertically oriented hooks 132 for engaging with and securing a latch 143*a*, 143*b* of the lift bar 140. The plurality of hooks 132 may be arranged in a vertical row for securing the lift bar 141 at different heights. Each bar holder 130*a*, 130*b* may further comprise a plurality of support sleeves 133 slidably mounted around a plurality of support posts 134, the plurality of support posts 134 being mounted vertically to the frame 110. The plurality of support posts 134 may each have a shock absorber 136 (e.g., a spring) statically mounted at a lower end thereof to absorb the shock when a user transfers the lift bar 140 back onto the bar holders 130*a*, 130*b* after an exercise. In another embodiment, as seen in FIG. 3B, the system 200 may comprise the bar holders 230*a*, 230*b* may each comprise a housing 238 enclosing a shock absorber 236 mounted between an upper portion 231 and a lower portion 234, the upper portion 231 comprising the hooks and the support post sleeves 233 and the lower portion 234 being operable to contact the weight sensor 237.

The first and second guide shafts 113*a*, 113*b* may limit the path of the lift bar 140 (via the first and second guide sleeves 142*a*, 142*b*) to vertical movement, preventing a user from falling forward or backward with the lift bar 140. The first and second guide shafts 113*a*, 113*b* may each also have a bump-stop 114 near its lower end, the bump-stop 114 providing a lower limit to the movement of the lift bar 140, and preventing a user from being trapped under or injured by a dropped lift bar 140. Each of the bump-stops 114 may comprise a sleeve for encircling the guide shaft 113*a*, 113*b*, and a tightening device (e.g., a threaded pin for tightening against the guide shaft) and may be adjustable in height along the length of the guide shaft 113*a*, 113*b*.

The first side 110*a* may comprise a first front panel 115*a* and the second side 110*b* may comprise a second front panel 115*b*. The second front panel 115*b* may comprise a housing with an access door 125 having a handle 124, and may house the bar position sensors 156 and a second interface 157. The first front panel 115*a* may also comprise a housing with an access door 125 having a handle 124, and may house the controller 150 and support a first interface 151 having an enunciator integrated therein, and an imaging device 152. The controller 150 may comprise a central processing unit and a memory, and may be in communication with and be operable to send information to and receive information from each of the memory, the interface first and second interfaces 151, 157, the communication device 158, and the plurality of sensors (e.g., the weight sensors 137*a*, 137*b*, the tampering sensors 153, the equipment sensor 154, the spotter sensors 155, and the bar position sensors 156).

The plurality of tampering sensors 153 may each comprise an infrared sensor operable to measure infrared radiation being emitted from a relatively warm object (e.g., a human, as opposed to a lift bar or weight plate) in the sensor's field of view (e.g., the area around the first or second end 140*a*, 140*b* of the lift bar). The plurality of tampering sensors 153 may be mounted to the frame at the front extension 121 and the rear extension 122 of each of the first side 110*a* and the second side 110*b*. These sensors may prevent a person from positioning themselves at the side of the frame 110 while someone is in the process of an exercise, such that such person cannot aid the lifter by applying force to the sleeves 140*a* or 140*b*. In other words, it prevents aiding or spotting of the lifter from the sides of the frame 110 during exercise.

The equipment sensor 154 may comprise a photo eye sensor operable to determine the presence and distance of a piece of equipment (not shown) underneath the lift bar 140. The equipment sensor 154 may be mounted to the frame 110 at a lower crossbar 120.

The plurality of spotter sensors 155 may each comprise a motion sensor operable to detect the motion of a spotter entering the area within the generally cubic shape of the frame 110 (e.g., the area between the first and second front panels 115*a*, 115*b* and the area between the first and second bar holders 130*a*, 130*b*). The plurality spotter sensors 155 may be mounted to the frame at the front upper crossbar 119 and the rear upper crossbar 118. In other words, the spotter sensors prevent aiding or spotting of the lifter during exercise from within the frame 110.

The bar position sensor 156 may comprise a plurality of proximity sensors arranged in a vertical stack, each proximity sensor being operable to detect the proximity of the lift bar 140 via the detection plate 145 as it passes vertically along the path of the first and second guide shafts 113*a*, 113*b*. The plurality of vertically arranged proximity sensors may be connected in parallel to a termination block 158, the termination block 158 being in electronic communication with the controller 150.

The foregoing descriptions of specific embodiments of the present invention have been presented for purposes of illustration and description. They are not intended to be exhaustive or to limit the invention to the precise forms disclosed, and many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A competitive weightlifting system for tracking and comparing weightlifting performance of a user with weightlifting performances of other users, the system comprising:

a. a frame including a rack for a lift bar and having a plurality of sensors positioned thereon operable to determine a position of the lift bar as said user moves said lift bar during said weightlifting performance;

b. a controller in electronic communication with said plurality of sensors and operable to identify positions of said lift bar during said weightlifting performance and generate positional data based on data from said plurality of sensors; and c. a user interface operable to allow said user to create a user account and sign into said user account prior to said weightlifting performance, wherein said controller collects said data from said weightlifting performance and stores said data in a memory, wherein said user interface is operable to display information regarding said weightlifting performances of said other users for competitive comparison of said weightlifting performance of said user and with said weightlifting performances of said other users.

2. The system of claim 1, further comprising at least one tampering sensor for detecting a person at an end of said lift bar while said lift bar is weighed by at least one weight sensor.

3. The system of claim 1, further comprising at least one spotter sensor for detecting a spotter assisting said user in lifting said lift bar.

4. The system of claim 1, wherein said plurality of sensors comprises bar position sensors at intervals along a vertical or substantially vertical path.

5. The system of claim 1, further comprising at least one equipment sensor for sensing a piece of equipment under said lift bar.

6. The system of claim 1, wherein said user interface is operable to display information related to said user account.

7. The system of claim 1, wherein said user interface is operable to allow said user to select a weightlifting exercise type and a performance type, and to clear an alert, wherein said user interface is operable to display information related to said user account.

8. The system of claim 1, further comprising a second interface operable to display information regarding said weightlifting performance of said user and to allow a subsequent user to select a subsequent user account of said subsequent user.

9. The system of claim 1, wherein said frame comprises at least one bar holder mounted over at least one weight sensor, said at least one weight sensor being operable to determine a weight of said lift bar.

10. The system of claim 1, wherein said memory being operable to store data regarding a user profile of said user account and said positional data, said data regarding said user profile comprising a user identification, a password, an image of said user, and said data from said weightlifting performance.

11. The system of claim 1, further comprising a communication device in electronic communication with said controller, wherein said communication device is operable to connect said controller to the internet and communicate with a remote computing device and receive data of said weightlifting performances of said other users.

12. The system of claim 11, wherein said controller is operable to:

a. receive information from said remote computing device, said information regarding a user profile and a performance of a competitive user,
b. record said information from said remote computing device into said memory, and
c. display said information from said remote computing device via said user interface.

13. A method of using a competitive weightlifting system, the method comprising the steps of:

a. providing said competitive weightlifting system comprising a frame, a lift bar, a controller having a memory, at least one equipment sensor, and a user interface;
b. logging into a user profile stored into said memory via said user interface;
c. selecting a type of weightlifting exercise via said user interface;
d. measuring a weight of said lift bar;
e. performance of said type of weightlifting exercise by a user; and
f. recording data related to said performance in said memory, wherein said controller is operable to connect to the internet via a telecommunication device and transmit data to a network of other competitive weightlifting systems to rank and display performance data recorded by said other competitive weightlifting systems in said network in a ranked list of user performances displayed via said user interface.

14. The method of claim 13, further comprising the steps of:

a. creating said user profile via said user interface;
b. storing data related to said user profile in said memory; and
c. displaying said data related to said performance via said user interface.

15. The method of claim 13, wherein said data related to said performance comprises information regarding at least one of said type of weightlifting exercise, said weight of said lift bar, and a number of valid repetitions of said type of weightlifting exercise performed by said user.

16. The method of claim 13, wherein said competitive weightlifting system further comprises at least one tampering sensor, at least one spotter sensor, and at least one bar position sensor.

17. The method of claim 16, further comprising the steps of:

a. sensing a position of said lift bar during said type of weightlifting exercise;
b. counting a number of valid repetitions of said type of weightlifting exercise; and
c. sounding a bar position alert if a repetition of said type of weightlifting exercise is not valid.

18. The method of claim 16, further comprising the steps of:

a. sensing for an object under said lift bar during said type of weightlifting exercise;
b. if a presence or absence of said object violates a rule of said type of weightlifting exercise, sounding an equipment alert.

19. The method of claim 13, further comprising the step of transmitting said data related to said performance to a remote computer via a communication device.

20. A competitive weightlifting system for tracking and comparing weightlifting performance of a user with weightlifting performances of other users, the system comprising:

a. a frame including a rack for a lift bar and having a plurality of sensors positioned thereon operable to determine a position of the lift bar as said user moves said lift bar during said weightlifting performance; and
b. a controller in electronic communication with at least one first sensor operable to sense a presence of an object under said lift bar during said weightlifting performance, and to activate an alarm if said presence of said object violates a rule of said weightlifting performance.

21. The system of claim 20, further comprising a user interface operable to allow said user to create a user account and sign into said user account prior to said weightlifting performance, wherein said controller collects said data from said weightlifting performance and stores said data in a memory and is operable to send said data to a remote computing device via a communication device.

22. The system of claim 20, wherein said plurality of sensors comprises bar position sensors at intervals along a vertical or substantially vertical path.

* * * * *